US011179939B2

(12) United States Patent
Kobayashi

(10) Patent No.: US 11,179,939 B2
(45) Date of Patent: Nov. 23, 2021

(54) DUMMY DISCHARGE RECEPTACLE, LIQUID DISCHARGE APPARATUS, AND PRINTER

(71) Applicant: Ricoh Company, Ltd., Tokyo (JP)

(72) Inventor: Yoshihiro Kobayashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 84 days.

(21) Appl. No.: 16/571,765

(22) Filed: Sep. 16, 2019

(65) Prior Publication Data

US 2020/0094560 A1 Mar. 26, 2020

(30) Foreign Application Priority Data

Sep. 21, 2018 (JP) ..... JP2018-177520

(51) Int. Cl.
*B41J 2/165* (2006.01)

(52) U.S. Cl.
CPC ..... *B41J 2/16505* (2013.01)

(58) Field of Classification Search
CPC ..... B41J 2/16505; B41J 2/16517
See application file for complete search history.

(56) References Cited

U.S. PATENT DOCUMENTS

2001/0013881 A1 8/2001 Matsumoto et al.
2009/0015632 A1* 1/2009 Suzuki ..... B41J 2/1721 347/36
2020/0316945 A1* 10/2020 Tanioku ..... B41J 2/16508

FOREIGN PATENT DOCUMENTS

| | | | |
|---|---|---|---|
| JP | 9-300656 | | 11/1997 |
| JP | 2000-203059 | | 7/2000 |
| JP | 2003-080739 | | 3/2003 |
| JP | 2003080739 | A * | 3/2003 |
| JP | 2004-009667 | | 1/2004 |
| JP | 2005-313426 | | 11/2005 |
| JP | 2006-027058 | | 2/2006 |
| JP | 2008-062629 | | 3/2008 |
| JP | 2011-110840 | | 6/2011 |
| JP | 2014-208472 | | 11/2014 |
| JP | 2016-132142 | | 7/2016 |
| JP | 2016-159450 | | 9/2016 |
| KR | 20200001915 | A * | 1/2020 |

* cited by examiner

*Primary Examiner* — Justin Seo
(74) *Attorney, Agent, or Firm* — Xsensus LLP

(57) ABSTRACT

A liquid absorber includes an absorbing member. The absorbing member includes a plurality of segments. One segment of the plurality of segments includes a liquid landing surface and a side surface. The liquid landing surface is configured to receive liquid discharged from a liquid discharge head to absorb the liquid. The side surface is perpendicular to the liquid landing surface and contacts a side surface of another segment of the plurality of segments.

20 Claims, 14 Drawing Sheets

DUMMY DISCHARGE RECEPTACLE, LIQUID DISCHARGE APPARATUS, AND PRINTER

CROSS-REFERENCE TO RELATED APPLICATION

This patent application is based on and claims priority pursuant to 35 U.S.C. § 119(a) to Japanese Patent Application No. 2018-177520, filed on Sep. 21, 2018, in the Japan Patent Office, the entire disclosure of which is hereby incorporated by reference herein.

BACKGROUND

Technical Field

Aspects of the present disclosure relate to a dummy discharge receptacle, a liquid discharge apparatus, and a printer.

Related Art

For example, a printer as a liquid discharge apparatus may perform dummy discharge as a maintenance operation of a liquid discharge head. In the dummy discharge (including operations called, e.g., flushing and purging), the printer discharges liquid that does not contribute to printing into a dummy discharge receptacle including an absorbing member.

SUMMARY

In an aspect of the present disclosure, there is provided a liquid absorber including an absorbing member. The absorbing member includes a plurality of segments. One segment of the plurality of segments includes a liquid landing surface and a side surface. The liquid landing surface is configured to receive liquid discharged from a liquid discharge head to absorb the liquid. The side surface is perpendicular to the liquid landing surface and contacts a side surface of another segment of the plurality of segments.

In another aspect of the present disclosure, there is provided a liquid discharge apparatus that includes the liquid absorber and the liquid discharge head configured to discharge the liquid onto a sheet material.

In still another aspect of the present disclosure, there is provided a dummy discharge receptacle that includes a landing target member configured to receive liquid discharged from a liquid discharge head. The landing target member includes a plurality of segments that is divided in a plane to receive the liquid discharged from the liquid discharge head.

In still yet another aspect of the present disclosure, there is provided a liquid discharge apparatus that includes the dummy discharge receptacle and a liquid discharge head configured to discharge the liquid onto a sheet material.

In still further yet another aspect of the present disclosure, there is provided a liquid discharge apparatus that includes a liquid discharge array, a dummy discharge receptacle, and an absorbing member. The liquid discharge array includes a plurality of liquid discharge heads arrayed in a direction perpendicular to a direction of conveyance of a sheet material. The dummy discharge receptacle is at a position opposed to the liquid discharge array. The absorbing member is accommodated in the dummy discharge receptacle. The absorbing member includes a plurality of segments arranged in plural at least in the direction perpendicular to the direction of conveyance of a sheet material. The liquid discharge array is configured to discharge liquid for dummy discharge onto the sheet material passing a sheet-material passage region and a segment of the plurality of segments including at least a region outside the sheet-material passing region.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
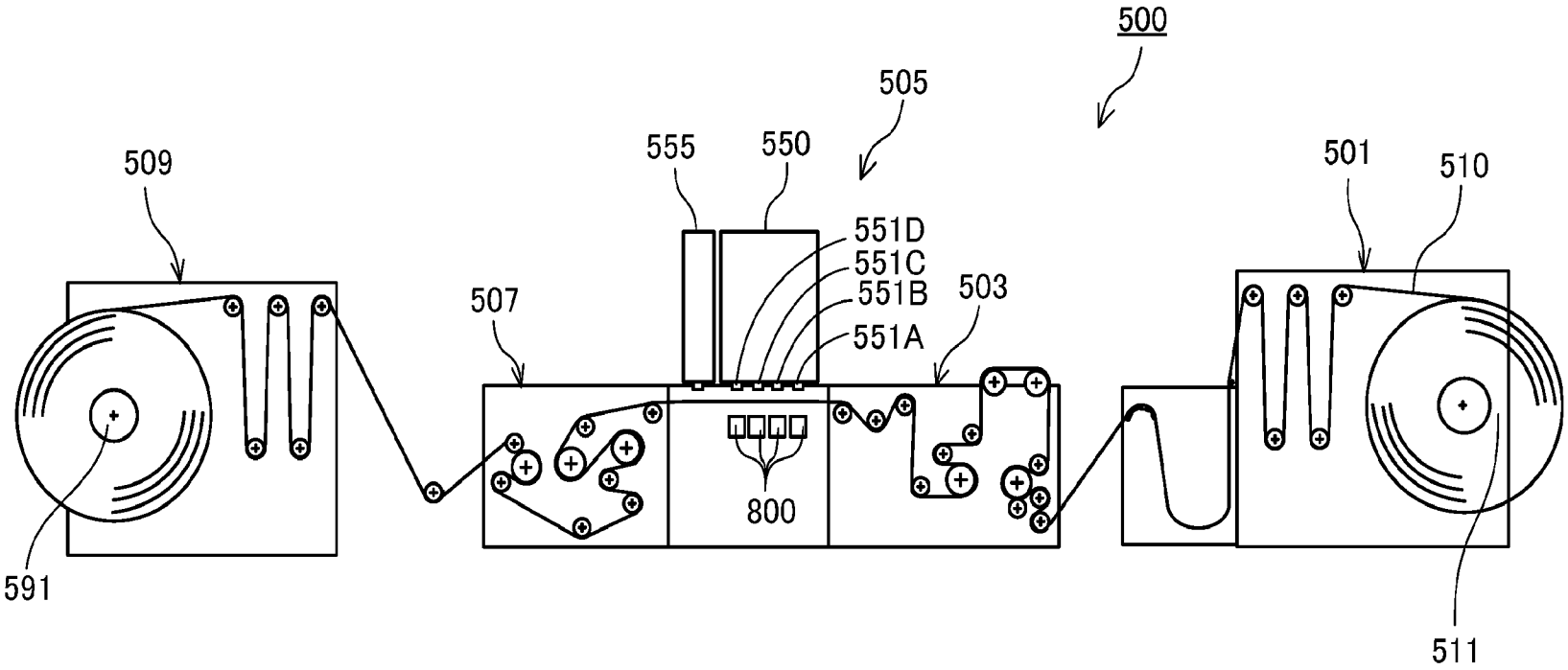
FIG. 1 is a schematic view of a configuration of an example of a printer as a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
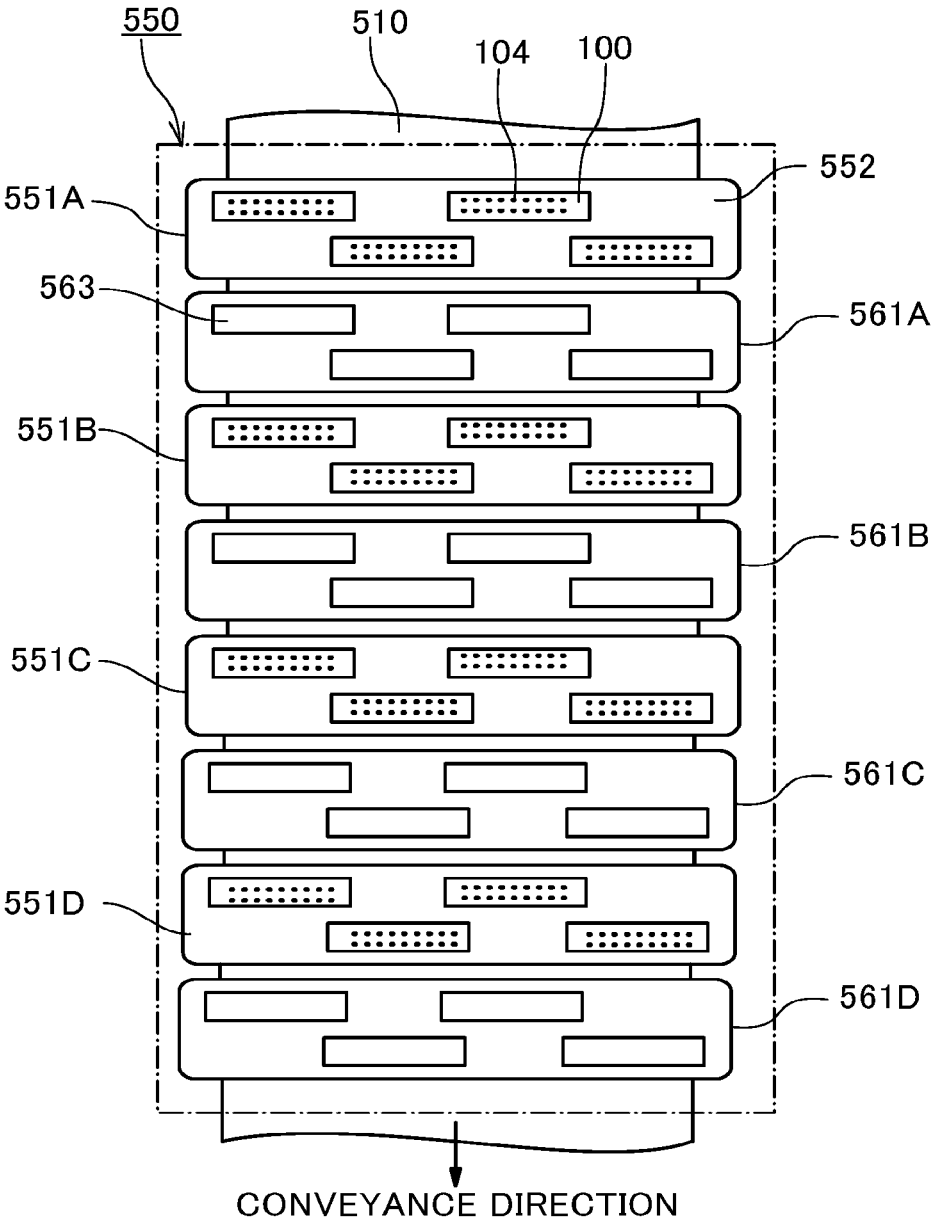
FIG. 2 is a plan view of a printing unit of the printer of FIG. 1.
Figure 3:
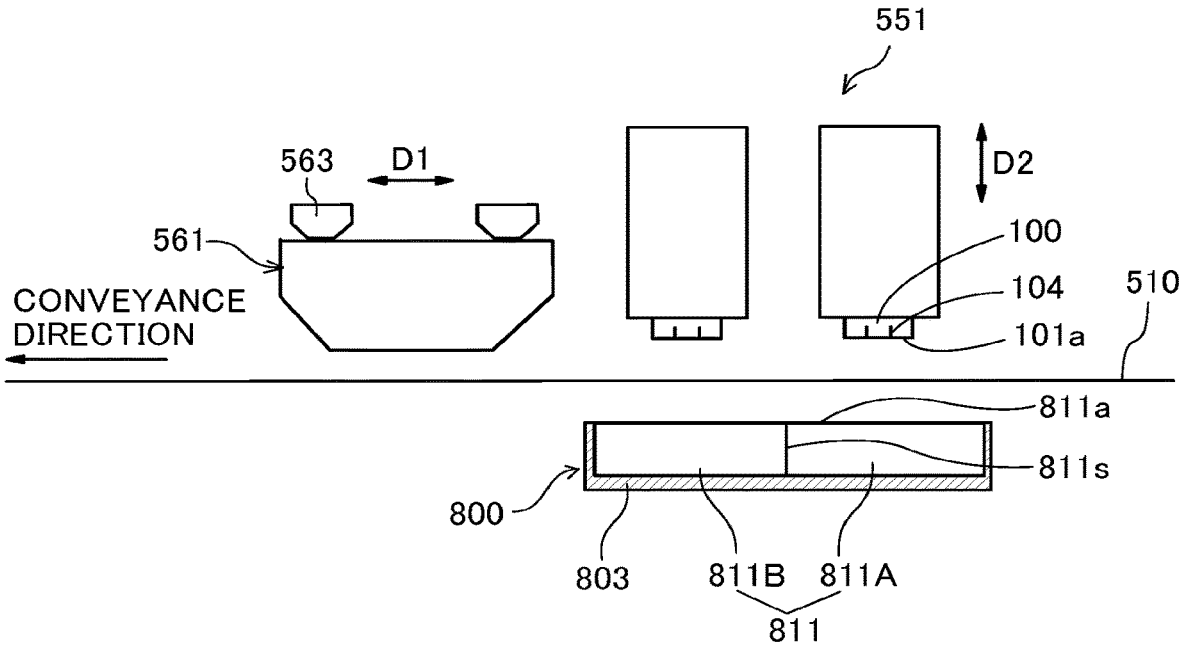
FIG. 3 is a side view of the printing unit of FIG. 2.

Embodiments of the present disclosure are described below with reference to the attached drawings. A printer as a liquid discharge apparatus according to the present embodiment is described with reference to FIGS. 1 to 3. FIG. 1 is a schematic view of a configuration of an example of the printer. FIG. 2 is a plan view of a printing unit of the printer of FIG. 1. FIG. 3 is a side view of the printing unit of FIG. 2.

A printer 500 as an example of the liquid discharge apparatus includes a feeder 501 to feed a sheet material 510, such as a rolled sheet, a guide conveyor 503 to guide and convey the sheet material 510, fed from the feeder 501, to a printing unit 505, the printing unit 505 to discharge liquid onto the sheet material 510 to form an image on the sheet material 510, a drier unit 507 to dry the sheet material 510, and an ejector 509 to eject the sheet material 510.

The sheet material 510 is fed from a winding roller 511 of the feeder 501, guided and conveyed with rollers of the feeder 501, the guide conveyor 503, the drier unit 507, and the ejector 509, and wound around a take-up roller 591 of the ejector 509.

In the printing unit 505, the sheet material 510 is conveyed so as to face the head unit 550 and the head unit 555. The head unit 550 discharges the liquid to form an image. Post-treatment is performed on the sheet material 510 with treatment liquid discharged from the head unit 555.

Here, in the head unit 550, for example, full-line head arrays 551A, 551B, 551C, and 551D (hereinafter, collectively referred to as head arrays 551 unless distinguished) for four colors are arranged from the upstream side in a direction of conveyance of the sheet material 510.

The head arrays 551K, 551C, 551M, and 551Y are liquid dischargers to discharge liquid of, for example, black (K), cyan (C), magenta (M), and yellow (Y) onto the sheet material 510 conveyed. The types and the number of colors are not limited to the above-described example.

In each of the head arrays 551, for example, as illustrated in FIG. 2, a plurality of liquid discharge heads 100 (also referred to as "heads") is arranged in a staggered manner on a base 552. In each head 100, a plurality of nozzles 104 to discharge liquid is arranged in two rows in a staggered manner. However, the configuration of the head arrays 551 is not limited to such a configuration.

Maintenance units 561 (561A to 561D) to maintain the heads 100 are arranged between the head arrays 551. Each maintenance unit 561 includes caps 563 to cap nozzle surfaces 101*a* of the heads 100.

Each maintenance unit 561 is movable back and forth in directions indicated by arrow D1 in FIG. 3. Each head array 551 is movable up and down in directions indicated by arrow D2 in FIG. 3. When capping is performed, the head arrays 551 move up and the maintenance unit 561 moves below the heads 100. Then, the head arrays 551 move down and the nozzle surfaces 101*a* of the heads 100 are capped by the caps 563.

Below the head arrays 551 is disposed a dummy discharge receptacle 800 according to an embodiment of the present disclosure that receives dummy discharge droplets discharged from the nozzles 104 of the head 100.

Figure 4:
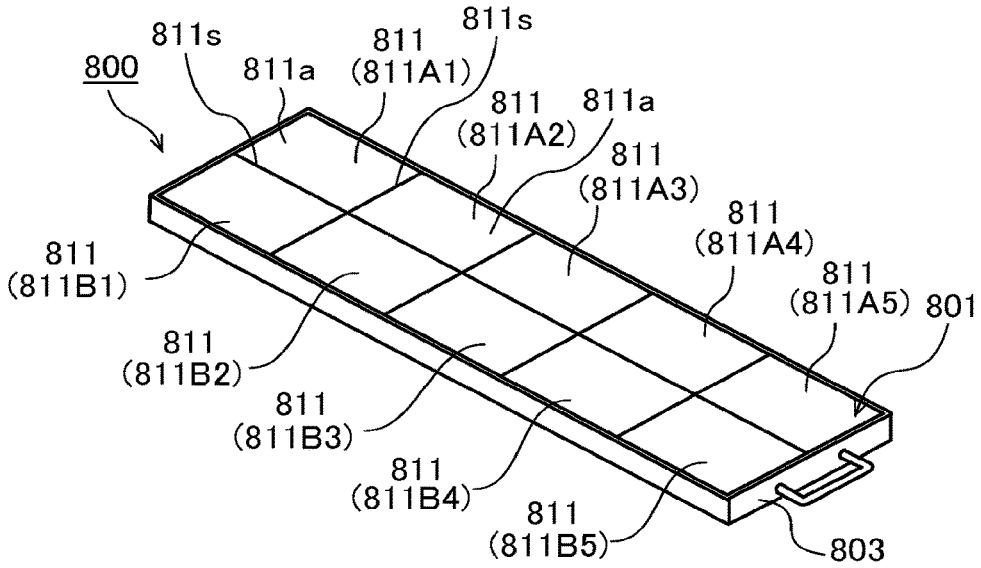
FIG. 4 is a perspective view of a dummy discharge receptacle according to a first embodiment of the present disclosure.
Figure 5:
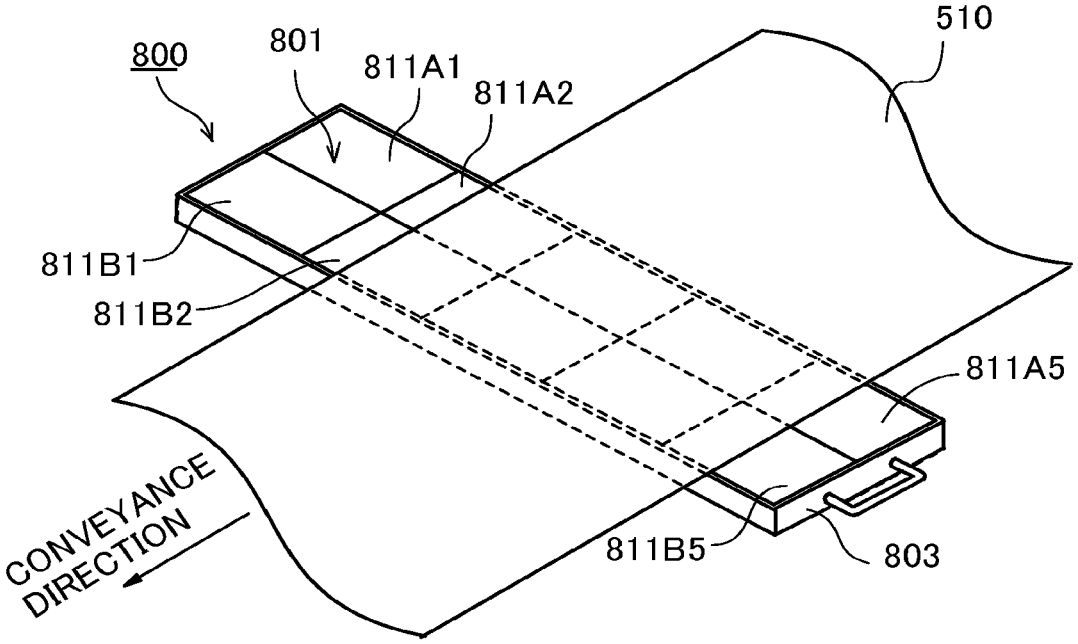
FIG. 5 is a perspective view of the dummy discharge receptacle of FIG. 4 with a sheet material.

Next, the dummy discharge receptacle according to a first embodiment of the present disclosure is described with reference to FIGS. 4 to 7. FIG. 4 is a perspective view of the dummy discharge receptacle according to the first embodiment. FIG. 5 is a perspective view of the dummy discharge receptacle with a sheet material.

The dummy discharge receptacle 800 includes an absorbing member (hereinafter, referred to as "first absorbing member") 801 and a tray 803 that is a receiving member to accommodate the first absorbing member 801. In the first embodiment, the first absorbing member 801 is a landing target member on which dummy discharge droplets discharged from the head land.

The first absorbing member 801 is divided into a plurality of individual blocks (block bodies or segments) 811 (blocks 811A1 to 811A5 and blocks 811B1 to 811B5) in a plane on which the dummy discharge droplets land. The blocks 811 are arranged side by side in the tray 803. The blocks 811 have respective liquid landing surfaces 811*a* to receive the dummy discharge droplets. The blocks 811 are arranged with side surfaces 811*s* of the blocks 811 contacting each other.

The first absorbing member 801 is preferably divided into at least three blocks 811 at both end portions and the central portion in a longitudinal direction (perpendicular to the direction of conveyance of the sheet material 510). In the present embodiment, the first absorbing member 801 is divided into five blocks 811A1 to 811A5 and five blocks 811B1 to 811B5 that are arranged side by side in the direction perpendicular to the direction of conveyance of the sheet material 510).

Such a configuration allows maintenance, such as replacement of only a block 811 that faces the head 100 in a region away from the sheet material 510 in the longitudinal direction and on which liquid (dummy discharge droplets) by dummy discharge lands.

The first absorbing member 801 is preferably divided in a transverse direction (along the direction of conveyance of the sheet material) according to the number of heads 100 arranged in the direction of conveyance. In the printer 500, the heads 100 are arranged in two rows in the staggered manner. Accordingly, in the present embodiment, the upstream blocks 811A (811A1 to 811A5) and the downstream blocks 811B (811B1 to 811B5) are divided and arranged in two rows side by side in the direction along the direction of conveyance of the sheet material.

Accordingly, each block 811 is opposed to any one of the upstream head 100 and the downstream head 100. In the region away from the sheet material 510, the area of one block 811 becomes smaller than an area on which liquid (dummy discharge droplets) discharged by dummy discharge land than a configuration in which blocks are simply divided in the longitudinal direction. Thus, the blocks that are subject to maintenance such as replacement can be further limited.

As the first absorbing member 801, a porous body, such as a melamine foam, having a high liquid permeation rate and a low capillary force can be used. The high liquid permeation rate allows the liquid having landed on the first absorbing member 801 to quickly penetrate into the inside of the first absorbing member 801. Accordingly, the liquid is unlikely to remain in the vicinity of the surface of the first absorbing member 801, thus reducing the growth of deposits.

Figure 6:
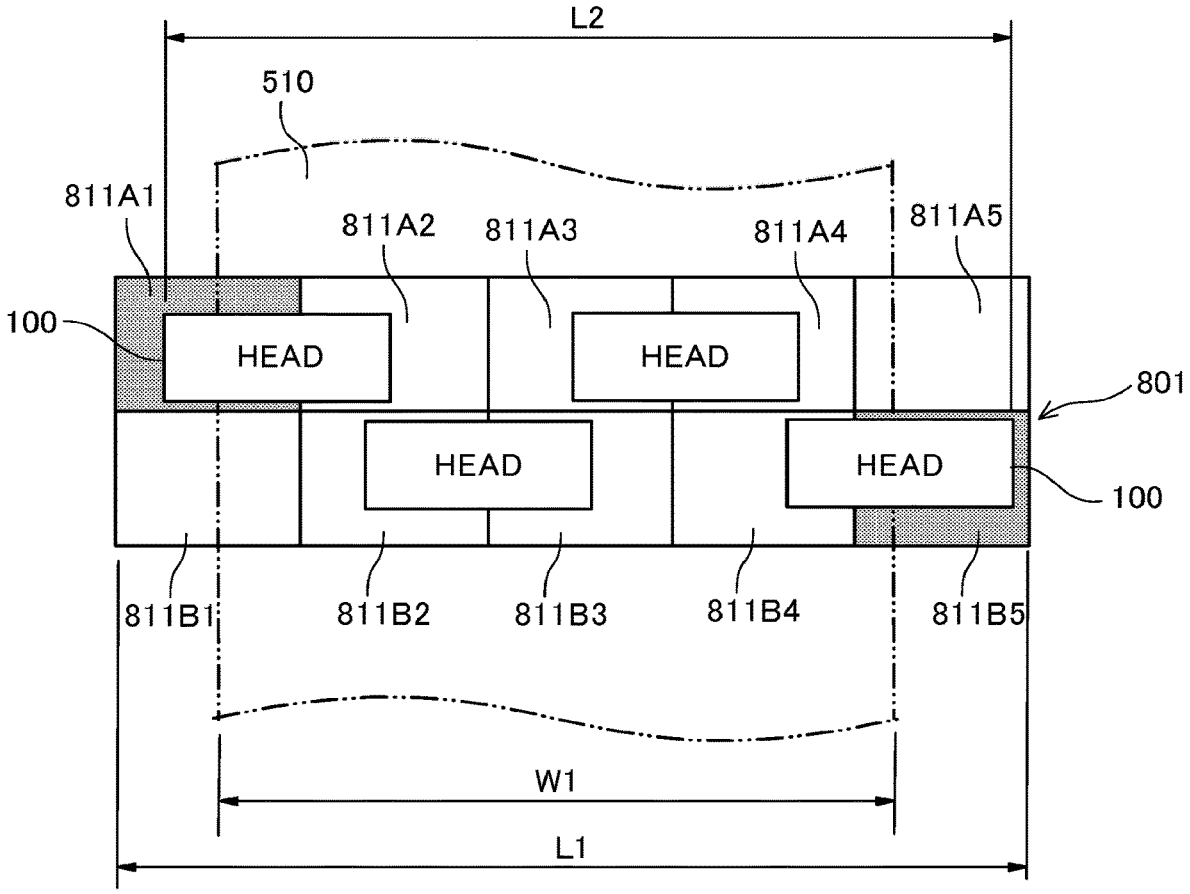
FIG. 6 is a plan view illustrating an example of positional relationship between the dummy discharge receptacle of FIG. 4, a head, and the sheet material.
Figure 7:
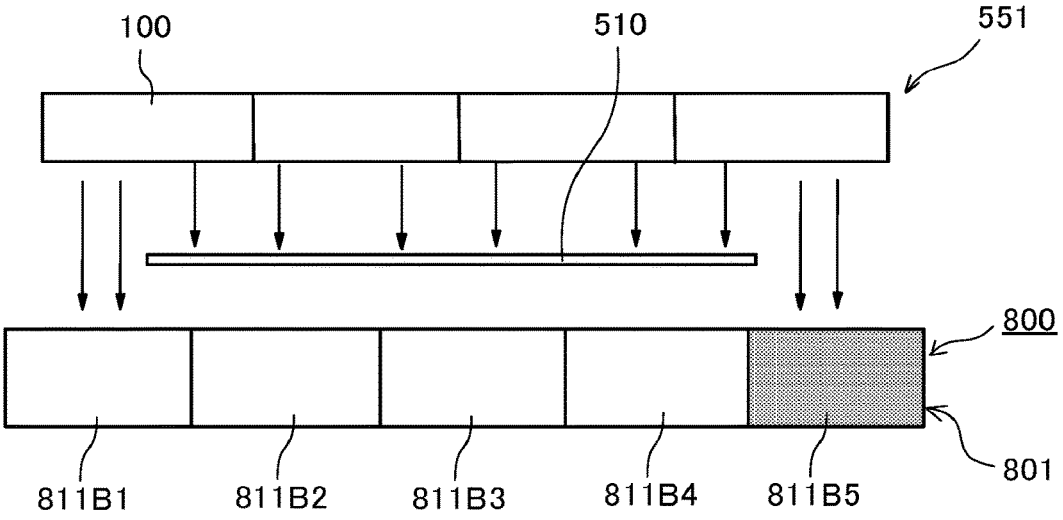
FIG. 7 is a front view of the example of the positional relationship of FIG. 6.
Figure 8:
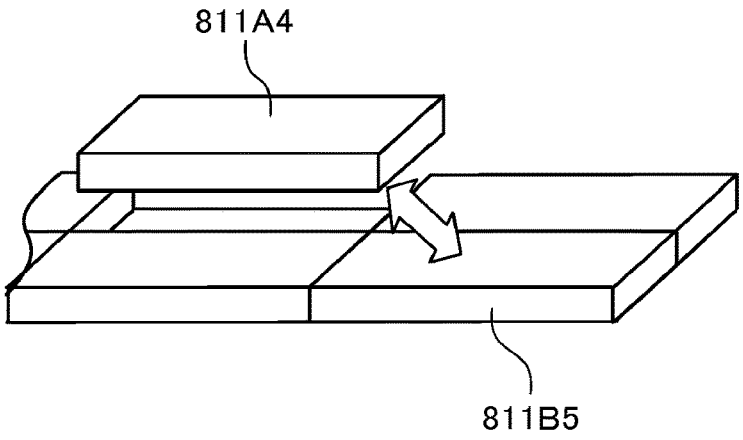
FIG. 8 is a perspective view of a case in which blocks of the dummy discharge receptacle are replaced with each other.

The melamine foam is prepared by, for example, mixing melamine and formaldehyde, which are main raw materials, or precondensates of melamine and formaldehyde with a foaming agent, a catalyst, an emulsifier, etc. The foam materials are injected into a mold, heated by a given way, foamed, cured, and further compressed to improve the foam volume and increase the liquid absorption capacity to a desired level. Next, the replacement of blocks of the dummy discharge receptacle in the present embodiment is described with reference to FIGS. 6 to 8. FIG. 6 is a plan view of an example of the positional relationship among the dummy discharge receptacle, the head, and the sheet material. FIG. 7 is a front view of the example of FIG. 6. FIG. 8 is a perspective view of a case in which blocks of the dummy discharge receptacle are replaced with each other.

In an apparatus that prints on the sheet material 510 such as a continuous sheet of paper, like the printer 500 described above, dummy discharge is performed with the sheet material 510 facing the heads 100. Accordingly, liquid (dummy discharge droplets) discharged by dummy discharge is landed on the sheet material 510 in a region in which the sheet material 510 is interposed between the dummy discharge receptacle 800 and the heads 100 in the direction perpendicular to the direction of conveyance, and is landed on the dummy discharge receptacle 800 only in a region in which the sheet material 510 is not interposed between the dummy discharge receptacle 800 and the heads 100.

For example, as illustrated in FIG. 6, the length L1 of the first absorbing member 801 in the longitudinal direction of the dummy discharge receptacle 800 is longer than the length L2 of a region in which the heads 100 are arranged in an array direction (perpendicular to the direction of conveyance of the sheet material). The dummy discharge receptacle 800 is disposed so that both ends of the first absorbing member 801 in the longitudinal direction of the dummy discharge receptacle 800 protrude from the region in which the heads 100 are arranged. Assuming that the sheet material 510 has a width W1 and is conveyed with reference to the center, liquid discharged by dummy discharge would land only on both ends of the dummy discharge receptacle 800.

In addition, when a liquid that is easily dried and deposited, such as a liquid having a high viscosity, is used, repeating dummy discharge may progress the deposition at both ends of the first absorbing member 801 and require replacement.

On the other hand, in the present embodiment, the first absorbing member 801 is divided into the blocks 811A1 to 811A5 and the blocks 811B1 to 811B5 in the direction perpendicular to the direction of conveyance. Therefore, the blocks 811 are divided into blocks 811 on which the liquid discharged by the dummy discharge lands and blocks 811 on which the liquid discharged by the dummy discharge does not land, depending on whether each block 811 faces the head 100 and the sheet material 510 is interposed between each block 811 and the head 100.

Similarly, the first absorbing member 801 is divided into the blocks 811A and the blocks 811B in the direction of conveyance. Therefore, the blocks 811 are divided into blocks 811 on which the liquid discharged by the dummy discharge lands and blocks 811 on which the liquid discharged by the dummy discharge does not land, depending on whether each block 811 faces the head 100 and the sheet material 510 is interposed between each block 811 and the head 100.

Here, the heads 100, the sheet material 510, and the blocks 811 of the first absorbing member 801 of the dummy discharge receptacle 800 are in the positional relationship illustrated in FIGS. 6 and 7. In such a case, the blocks 811 on which the liquid dummy-discharged from the head 100 lands are only the upstream block 811A1 and the downstream block 811B5.

As illustrated in FIGS. 4 to 6, the blocks 811A1 to 811A5 and 811B1 to 811B5 have the same shape. Accordingly, when the absorbing member is replaced, for example, as illustrated in FIG. 8, the block 811B5 on which the liquid discharged by the dummy discharge lands is replaced with the block 811A4 on which the liquid discharged by the dummy discharge does not land. Thus, the block 811B5 can be replaced with a new absorbing member. Note that, instead of the other block 811 of the same dummy discharge receptacle 800, a new block can be separately mounted.

Figure 9:
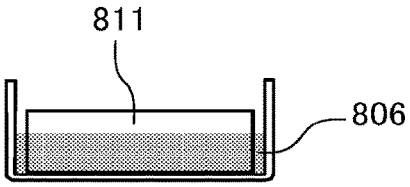
FIG. 9 is a perspective view of moisturizing liquid impregnated into the blocks of the dummy discharge receptacle.

Next, impregnation of moisturizing liquid into blocks of the dummy discharge receptacle in the present embodiment is described with reference to FIG. 9. FIG. 9 is a perspective view of moisturizing liquid impregnated into the blocks of the dummy discharge receptacle.

The first absorbing member 801 is preferably impregnated with moisturizing liquid. Impregnating the first absorbing member 801 with the moisturizing liquid can restrain the drying of the liquid that has been discharged by dummy discharge and has landed on the surface of the first absorbing member 801, thus restraining the growth of the deposit.

Further, when the density of the liquid discharged by dummy discharge is lower than the density of the moisturizing liquid, the permeation of the liquid into the first absorbing member 801 is promoted, thus restraining the growth of the deposit near the surface of the first absorbing member 801.

As the moisturizing liquid, for example, a cleaning liquid for an inkjet recording apparatus may be used. Examples of organic solvent added to the cleaning liquid include polyhydric alcohols having an equilibrium water content of 30% by mass or more in an environment of 23° C. and 80% relative humidity (RH).

Examples of the polyhydric alcohols include 1,2,3-butanetriol (38% by mass), 1,2,4-butanetriol (41% by mass), glycerin (49% by mass), diglycerin (38% by mass), triethylene glycol (39% by mass), tetraethylene glycol (37% by mass), diethylene glycol (43% by mass), and 1,3-butanediol (35% by mass). Among the examples, particularly, glycerin and 1,3-butanediol are preferably used because the viscosity can be reduced when glycerin and 1,3-butanediol absorb moisture. When such a water-soluble organic solvent is used in an amount of 20% by mass or more of the entire treatment liquid, it is preferable because sticking of waste liquid (waste ink) can be prevented.

Here, as described above with reference to FIG. 6 and FIG. 7, in the dummy discharge receptacle 800 of the present embodiment, the blocks 811 on which the liquid discharged from the head 100 lands are only the upstream block 811A1 and the downstream block 811B5.

Therefore, as illustrated in FIG. 9, the block 811 is immersed in the moisturizing liquid 806 and the block 811 impregnated with the moisturizing liquid 806 is stored in the tray 803 as the block 811A1 or the block 811B5.

Similarly, as described above with reference to FIG. 8, for example, when the block 811B5 is replaced with the block 811A4, the block 811A4 is taken out and impregnated with the moisturizing liquid 806, and then set as the block 811B5.

That is, the moisturizing liquid 806 is impregnated in the blocks 811 including a region outside a sheet-material passage region that the sheet material 510 passes, among the plurality of blocks 811 of the first absorbing member 801.

As described above, when the absorbing member of the dummy discharge receptacle 800 is replaced or impregnated with the moisturizing liquid, the replacement or impregnation can be performed in unit of block. Thus, the maintenance of the dummy discharge receptacle 800 can be facilitated and the consumption of the absorbing member and the consumption of the moisturizing liquid can be reduced.

Figure 10:
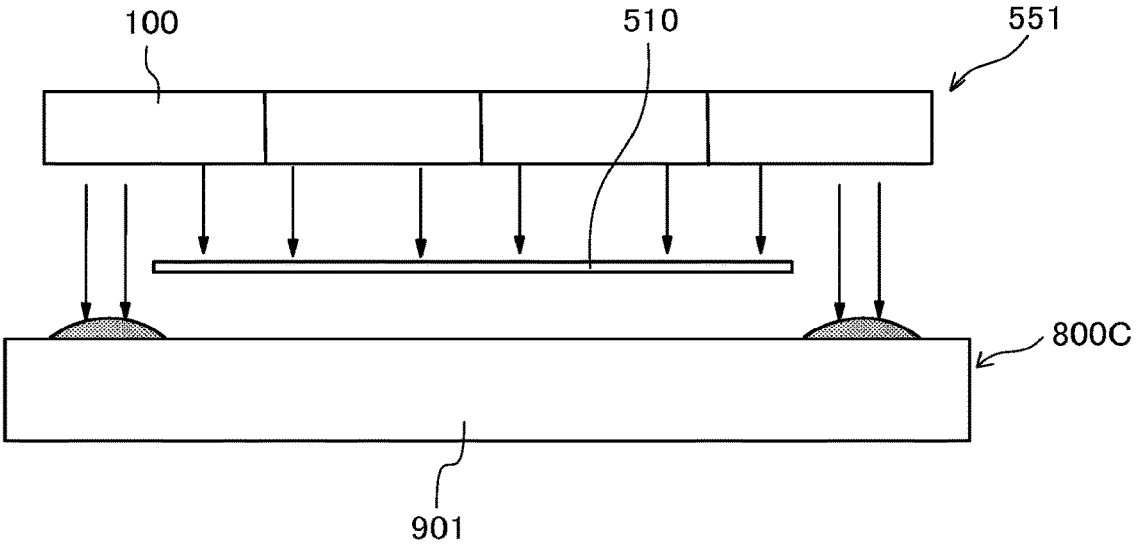
FIG. 10 is a front view of a dummy discharge receptacle of a comparative example together with a head and a sheet material.

Here, a comparative example is described with reference to FIG. 10. FIG. 10 is a front view of a dummy discharge receptacle of the comparative example together with a head and a sheet material.

In the comparative example, a single sheet of absorbing member 901 is disposed in a dummy discharge receptacle 800C.

Accordingly, in the comparative example, the liquid discharged by dummy discharge lands only in the regions at both ends in the direction perpendicular to the direction of conveyance of the single sheet of absorbing member 901. However, since the single sheet of absorbing member 901 is used, the entire absorbing member 901 needs to be replaced or cleaned. Further, when the single sheet of absorbing member 901 is impregnated with the moisturizing liquid, the entire absorbing member 901 needs to be immersed in the moisturizing liquid 806.

Accordingly, in the comparative example, the workability of the maintenance of the dummy discharge receptacle is reduced, and the consumptions of the absorbing member and the moisturizing liquid increase unnecessarily.

Figure 11:
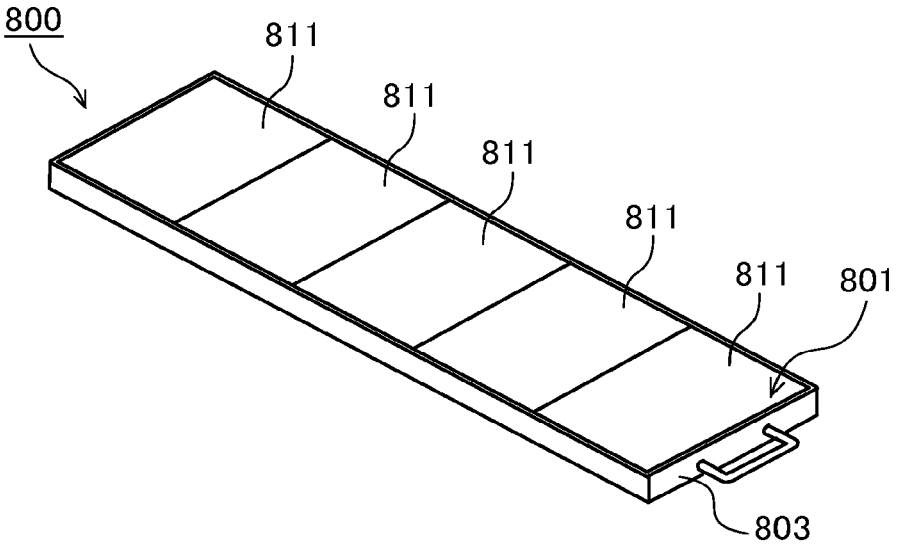
FIG. 11 is a perspective view of a dummy discharge receptacle according to a second embodiment of the present disclosure.

Next, a dummy discharge receptacle according to a second embodiment of the present disclosure is described with reference to FIG. 11. FIG. 11 is a perspective view of the dummy discharge receptacle according to the second embodiment.

In the second embodiment, the first absorbing member 801 is divided into five pieces of separate blocks 811 in the longitudinal direction of the first absorbing member 801 and is not divided in the transverse direction of the first absorbing member 801. In the second embodiment, the first absorbing member 801 is a landing target member on which dummy discharge droplets discharged from the head land.

Even in such a configuration, the size of the absorbing member that is replaced or impregnated with the moisturizing liquid is smaller than when the single sheet of absorbing member is used, and the maintainability of the dummy discharge receptacle 800 is enhanced. Moreover, the consumption of the absorbing member and the consumption of the moisturizing liquid can be reduced.

Figure 12:
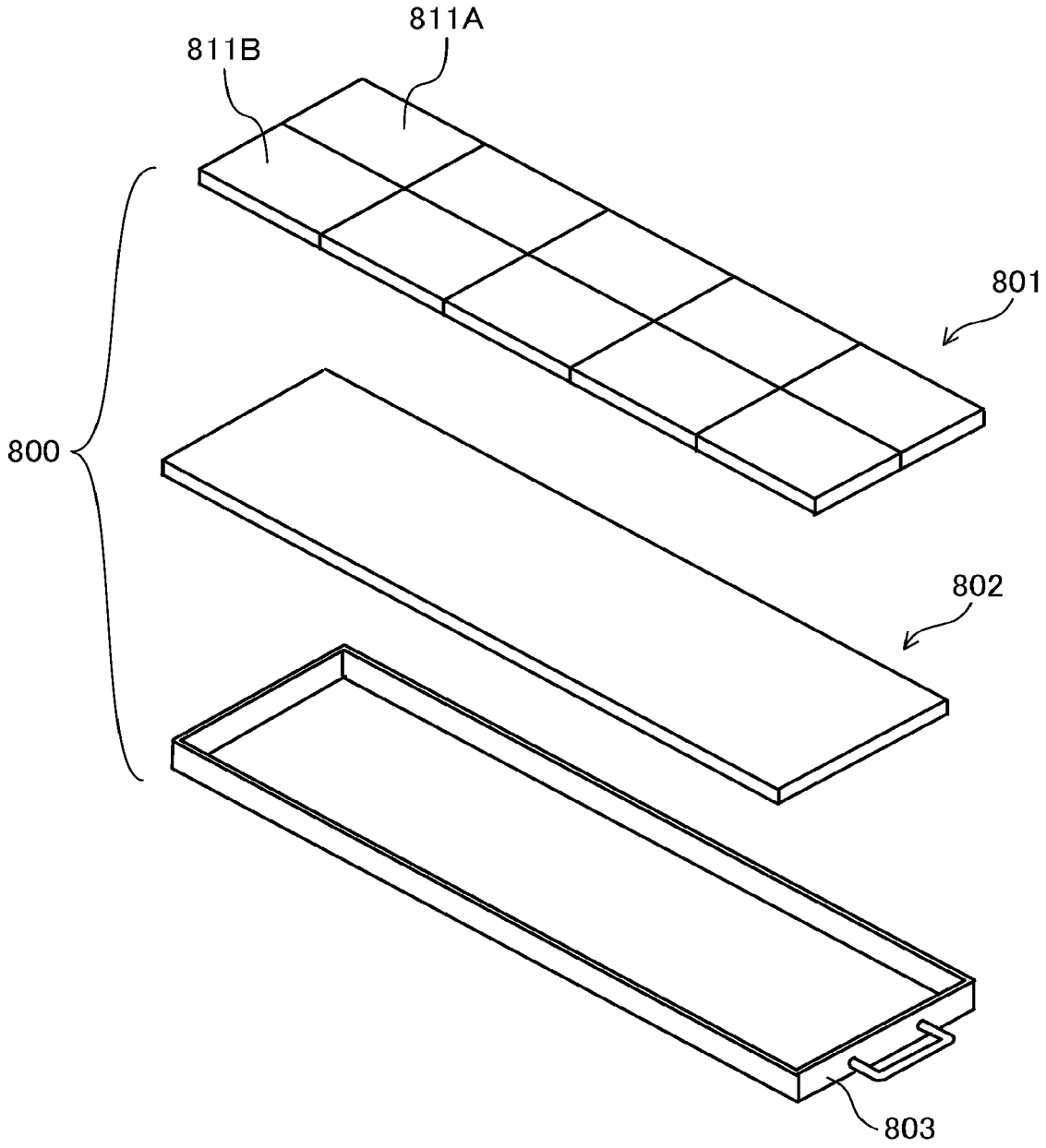
FIG. 12 is an exploded perspective view of a dummy discharge receptacle according to a third embodiment of the present disclosure.
Figure 13:
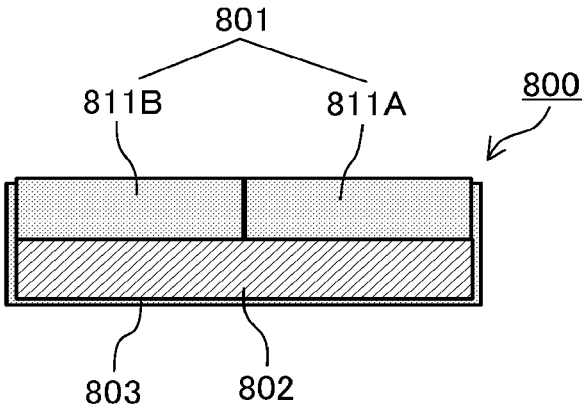
FIG. 13 is a cross-sectional view of the dummy discharge receptacle of FIG. 12 in the transverse direction.
Figure 14:
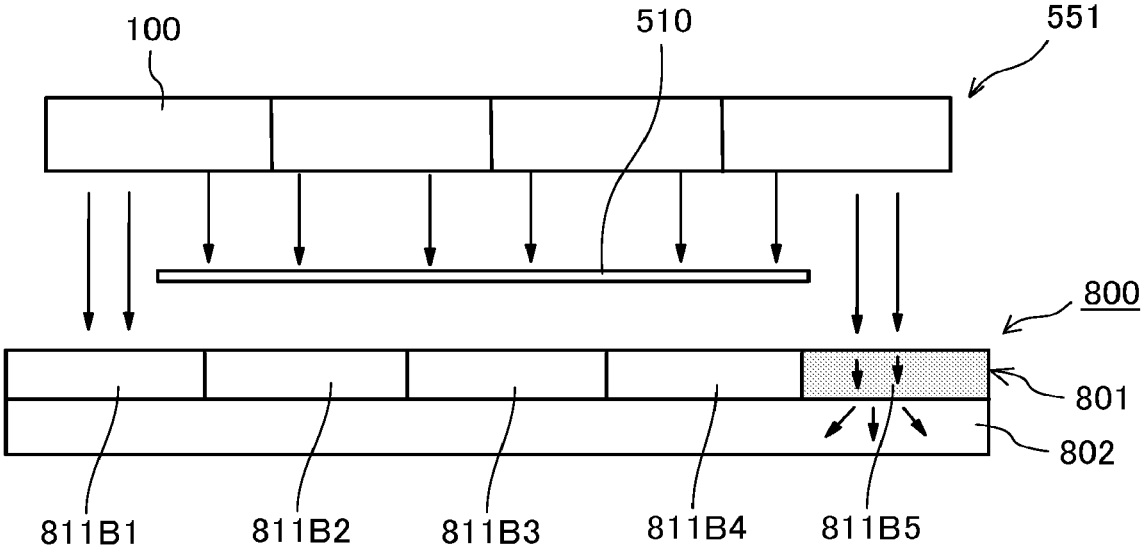
FIG. 14 is a front view of an example of the positional relationship between the dummy discharge receptacle, the head, and the sheet material in the third embodiment.

Next, a dummy discharge receptacle according to a third embodiment of the present disclosure is described with reference to FIGS. 12 to 14. FIG. 12 is an exploded perspective view of the dummy discharge receptacle according to the third embodiment. FIG. 13 is a cross-sectional view of the dummy discharge receptacle of FIG. 12 in the transverse direction. FIG. 14 is a front view of an example of the positional relationship between the dummy discharge receptacle, the head, and the sheet material. The plane view of the positional relationship between the dummy discharge receptacle, the head, and the sheet material is the same as FIG. 6. Moreover, in FIG. 12, the codes of blocks of the first absorbing member are attached in simplified form.

The dummy discharge receptacle 800 includes a first absorbing member 801 as an upper layer, a second absorbing member 802 as a lower layer, and a tray 803 that is a receiving member to accommodate the first absorbing member 801 and the second absorbing member 802. Note that two or more layers may be disposed below the first absorbing member 801. In the third embodiment, the first absorbing member 801 is a landing target member on which dummy discharge droplets discharged from the head land.

In the third embodiment, the second absorbing member 802 is not divided and is a single sheet of absorbing member. In some embodiments, the second absorbing member 802 may also be divided. However, the area of each of blocks obtained by dividing the second absorbing member 802 is preferably larger than the area of one block 811 of the first absorbing member 801.

Further, the first absorbing member 801 has a higher liquid permeability and a lower capillary force than the second absorbing member 802. The second absorbing member 802 has a higher capillary force and has a greater liquid retention amount than the first absorbing member 801.

For example, a porous body such as a melamine foam is used for the first absorbing member 801, and a material such as polyester felt is used for the second absorbing member 802.

Such a configuration can prevent the liquid (dummy discharge droplets: waste liquid) discharged by dummy discharge from drying and depositing on the first absorbing member 801, quickly permeate the liquid into a lower part below the first absorbing member 801, and flow the liquid toward the second absorbing member 802.

The second absorbing member 802 can diffuse the liquid received from the first absorbing member 801 in an in-plane direction and can uniformize the stored liquid in the in-plane direction of the second absorbing member 802.

For example, as indicated by arrows in FIG. 14, the liquid that has landed on the block 811B5 of the first absorbing member 801 quickly permeates and flows to the second absorbing member 802 and diffuses in the second absorbing member 802.

Such a configuration can increase the amount of printing until the first absorbing member 801 and the second absorbing member 802 reaches liquid storage limits, and reduce the replacement frequency of the absorbing members.

For example, the direction of fiber material of the second absorbing member 802 is aligned in the in-plane direction, thus enhancing the capillary force and the diffusion force to the in-plane direction.

Further, in the present embodiment, the positional relationship between the dummy discharge receptacle, the head, and the sheet material and the width of the sheet material are the same as those in FIG. 6 described in the first embodiment. The liquid discharged by the dummy discharge lands on the upstream block 811A1 and the downstream block 811B5 on both ends of the first absorbing member 801 in the longitudinal direction of the first absorbing member 801.

Therefore, the moisturizing liquid 806 is impregnated in the upstream block 811A1 and the downstream block 811B5 at both ends of the first absorbing member 801.

Figure 15:
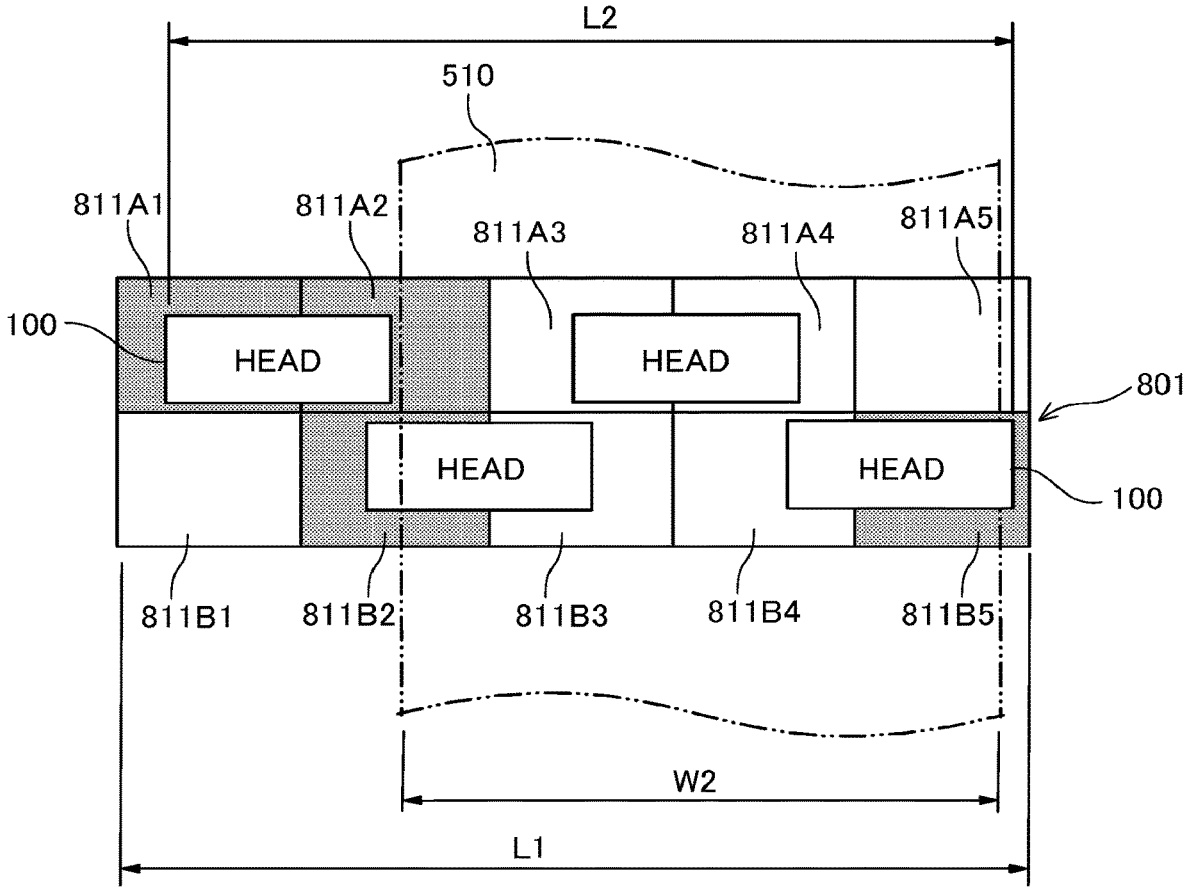
FIG. 15 is a plan view of another example of the relationship between the sheet material conveyance area and the block impregnated with the moisturizing liquid when the dummy discharge receptacle according to the third embodiment is used.
Figure 16:
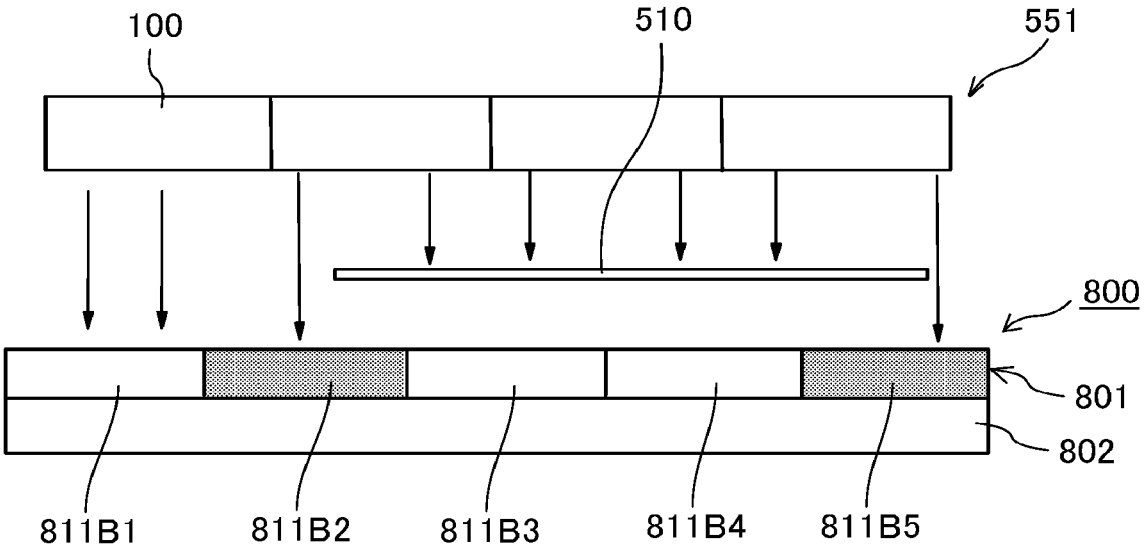
FIG. 16 is a front view of the example of the positional relationship of FIG. 15.

Next, another example of the relationship between the sheet material conveyance area and the block impregnated with the moisturizing liquid when the dummy discharge receptacle according to the third embodiment is used is described with reference to FIGS. 15 and 16. FIG. 15 is a plan view illustrating the positional relationship between the dummy discharge receptacle, the head, and the sheet material. FIG. 16 is a front view illustrating the positional relationship of FIG. 15.

In this example, as in FIG. 6, the length L1 of each of the first absorbing member 801 and the second absorbing member 802 in the longitudinal direction of the dummy discharge receptacle 800 is longer than the length (span) L2 of a region in which the heads 100 are arranged in the direction perpendicular to the direction of conveyance. The dummy discharge receptacle 800 is disposed so that both ends of the first absorbing member 801 and the second absorbing member 802 in the longitudinal direction protrude beyond the region in which the heads 100 are arranged.

The sheet material 510 has a width W2 (W2<L1) and is conveyed with reference to an end of the sheet material 510 in the direction perpendicular to the direction of conveyance.

Here, when the sheet material 510 is conveyed with reference to the end of the sheet material 510, the sheet material 510 is conveyed so that the other end of the sheet material 510 is inner than an end of the head 100 on the block 811B2 in the direction perpendicular to the direction of conveyance.

Accordingly, the liquid discharged by dummy discharge land on not only the upstream block 811A1 but also the downstream block 811B5 at the downstream end, the block 811A2 opposed to the upstream head 100 due to the narrow width, and the block 811B2 opposed to the downstream head 100.

Therefore, in the present example, the moisturizing liquid 806 is impregnated in the upstream block 811A1, the downstream block 811B5, and the block 811B2 at both ends of the first absorbing member 801.

Figure 17:
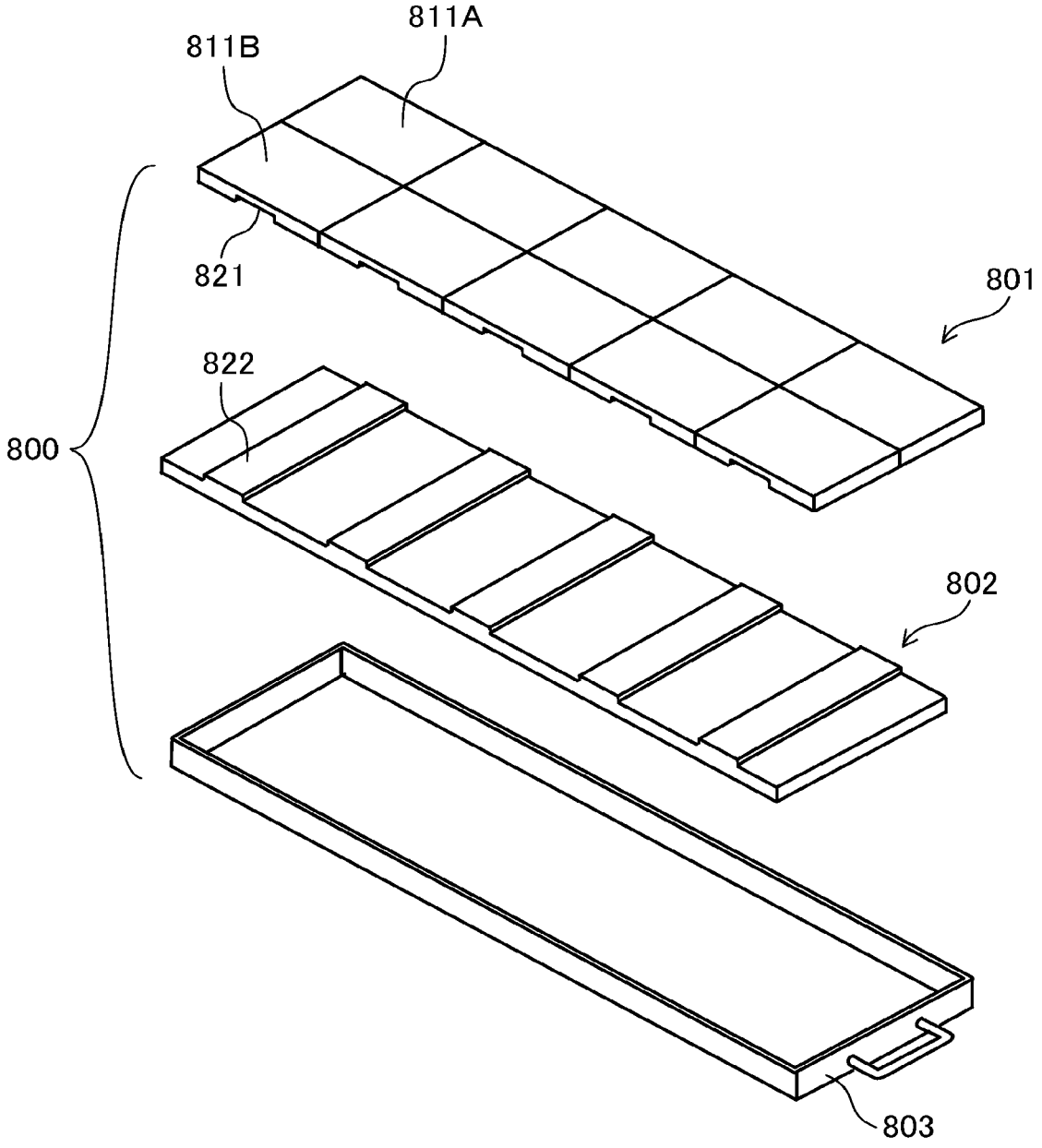
FIG. 17 is an exploded perspective view of a dummy discharge receptacle according to a fourth embodiment of the present disclosure.

Next, the dummy discharge receptacle according to a fourth embodiment of the present disclosure is described with reference to FIG. 17. FIG. 17 is an exploded perspective view of the dummy discharge receptacle according to the fourth embodiment. In the fourth embodiment, the first absorbing member 801 is a landing target member on which dummy discharge droplets discharged from the head land.

In the present embodiment, one or more concave portions 821 are provided on a bottom surface of the first absorbing member 801 and convex portions 822 corresponding to the concave portions 821 of the first absorbing member 801 are provided on the second absorbing member 802 so that the first absorbing member 801 and the second absorbing member 802 fit together by convex-concave fitting.

In such a configuration, the concave portions 821 of the first absorbing member 801 are fitted with the convex portions 822 of the second absorbing member 802 to increase the contact area between the first absorbing member 801 and the second absorbing member 802, thus enhancing the delivery efficiency of the liquid to the second absorbing member 802.

In addition, since the first absorbing member 801 and the second absorbing member 802 are fitted by convex-concave fitting, the installation positions of the first absorbing member 801 and the second absorbing member 802 are stabilized, thus facilitating the installation and preventing the position of the absorbing members from being deviated due to an air current generated in the apparatus.

In some embodiments, one or more convex portions 822 may be provided on the bottom surface of the first absorbing member 801 and the concave portions 821 may be provided on the second absorbing member 802 at positions corresponding to the convex portions 822 of the first absorbing member 801. Further, the number of convex portions and concave portions are not limited to the number illustrated in FIG. 17 and the direction of rows of convex portions and concave portions may be any of the direction of conveyance of the sheet material and the direction perpendicular to the direction of conveyance of the sheet material.

Next, an example in which a melamine foam (melamine absorbing body) is used for the first absorbing member 801 is described.

Use of a melamine foam (melamine absorbing body) for the first absorbing member 801 can reduce the deposit of the liquid dummy-discharged on the first absorbing member 801. Such reduction is caused because the melamine foam has a higher absorption rate and a smaller capillary force than other porous bodies.

Figure 18:
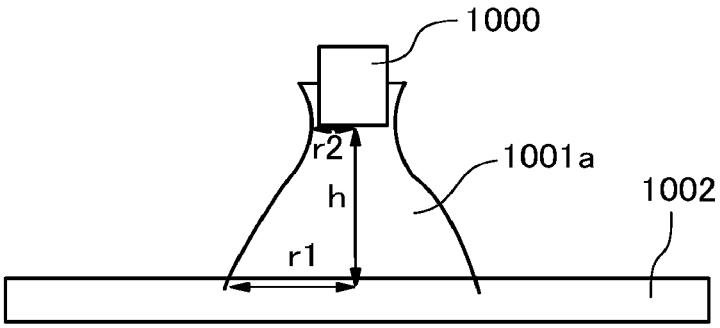
FIG. 18 is an illustration of a measuring method of absorption rate of an absorbing member (absorbing body)
Figure 19:
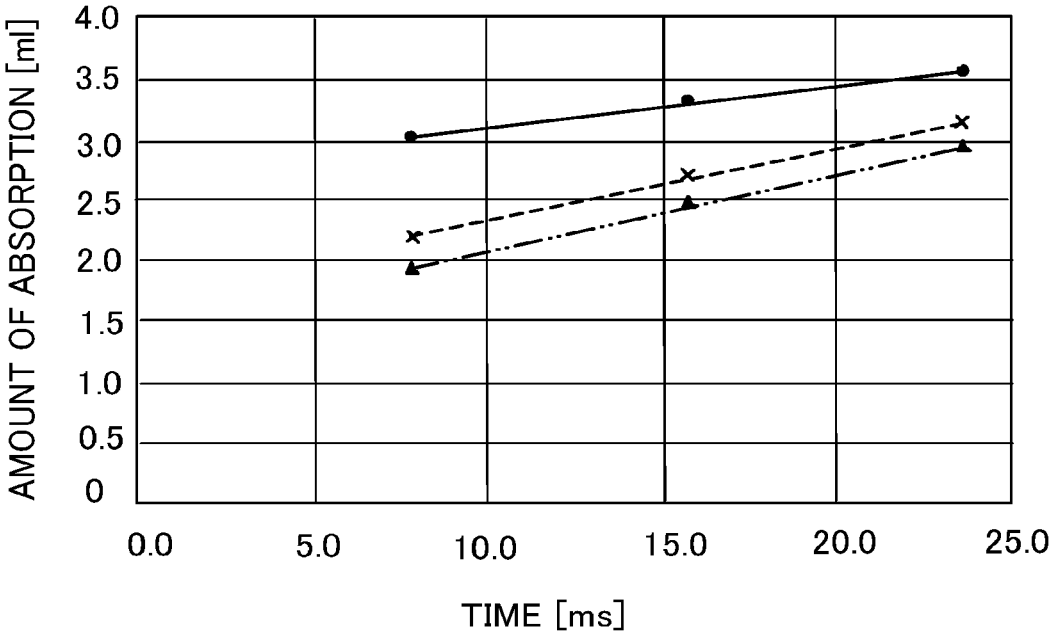
FIG. 19 is an illustration of an example of measurement results of the absorption rate.

Here, an example of measurement of the absorption rate of an absorbing member (also referred to as an absorbing body) is described with reference to FIGS. 18 and 19. FIG. 18 is an illustration of a measuring method of the absorption rate. FIG. 19 is an illustration of an example of measurement results of the absorption rate.

<Evaluation Procedure>

A procedure of evaluation is described with reference to FIG. 18.

1) A syringe filled with ink 1001 is set in a contact angle measuring device.

2) An ink droplet 1001*a* of 3.5 to 3.8 μl is formed at the tip of an injection needle 1000.

3) A measurement sponge (absorbing body) 1002 is brought into contact with the ink droplet 1001*a* from below on a manual stage.

4) The behavior of the ink droplet 1001*a* absorbed by the absorbing body 1002 at the contact is photographed with a high-speed camera.

5) The elapsed time and the amount of absorption from the moment when the absorbing body 1002 contacts the ink droplet 1001*a* are plotted, and the absorption rate of dropped ink is calculated from the inclination of the amount of absorption relative to the elapsed time. The amount of absorption at a certain time is calculated by subtracting an unabsorbed ink droplet volume at a certain time from an initial ink droplet volume.

<Evaluation Device>

[Contact angle measuring device] Manufacturer: Data Physics Corporation Model number of Manufacturer: OCA200H

[Syringe] Measuring instrument No.: 02-0144-T Injection needle: SNS052/026 Dosing needle (Outer diameter: 0.52 mm/Inner diameter: 0.26 mm/Length: 51 mm)

<Evaluation Conditions>

Ink: ink having a resin content of 5% by mass or more (described later) Environment: 23° C. and 50% RH Measurement video: 127 frames per second (fps)

<Calculation of Ink Droplet Volume>

From a photographed image, the ink droplet volume V that has not been absorbed by the absorbing body 1002 is calculated.

Here, the shape of the ink droplet 1001*a* was assumed to be a truncated cone, and the ink droplet volume V was calculated by the equation of $V=(1/3)\cdot\pi h\,(r1^2+r1\cdot r2+r2^2)$.

Thus, for example, as illustrated in FIG. 19, a graph of the amount of absorption with respect to time can be obtained, and the absorption rate of dropped ink was calculated from the inclination.

Figure 20:
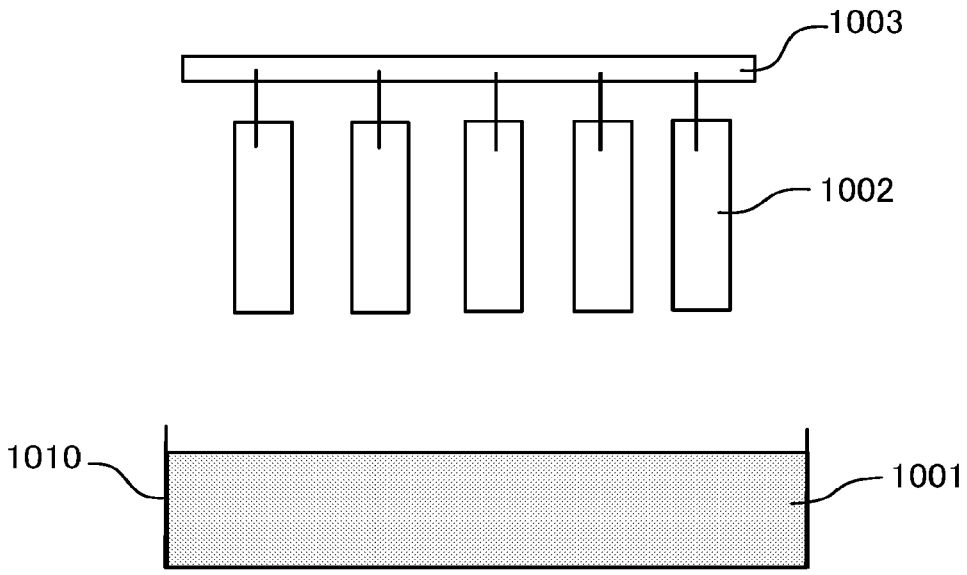
FIG. 20 is an illustration of an evaluation experiment of the measurement of capillary forces of absorbing members.

Next, the measurement of capillary force is described with reference to FIG. 20. FIG. 20 is an illustration of an evaluation experiment of the measurement of capillary force.

<Evaluation Procedure>

1) Absorbing bodies 1002 are suspended from a support member 1003 and the height positions of lower ends of the absorbing bodies 1002 are aligned.

2) An ink pool 1010 containing the ink 1001 is raised from below.

3) The ink pool 1010 is secured at a position at which the tips of the absorbing bodies 1002 is immersed in ink by about 5 mm.

4) The heights of ink absorbed in the absorbing bodies 1002 are measured when five minutes has elapsed since the ink 1001 begins to soak into the tips of the absorbing bodies 1002.

5) The measured height [mm] of absorbed ink is defined as capillary force.

<Evaluation Conditions>

Ink: ink with a resin content of 5% by mass or more

Environment: 23° C. and 50% RH

Cross sectional area of absorbing body: 50 $mm^2$

Depth of ink pool: 10 mm

Figure 21:
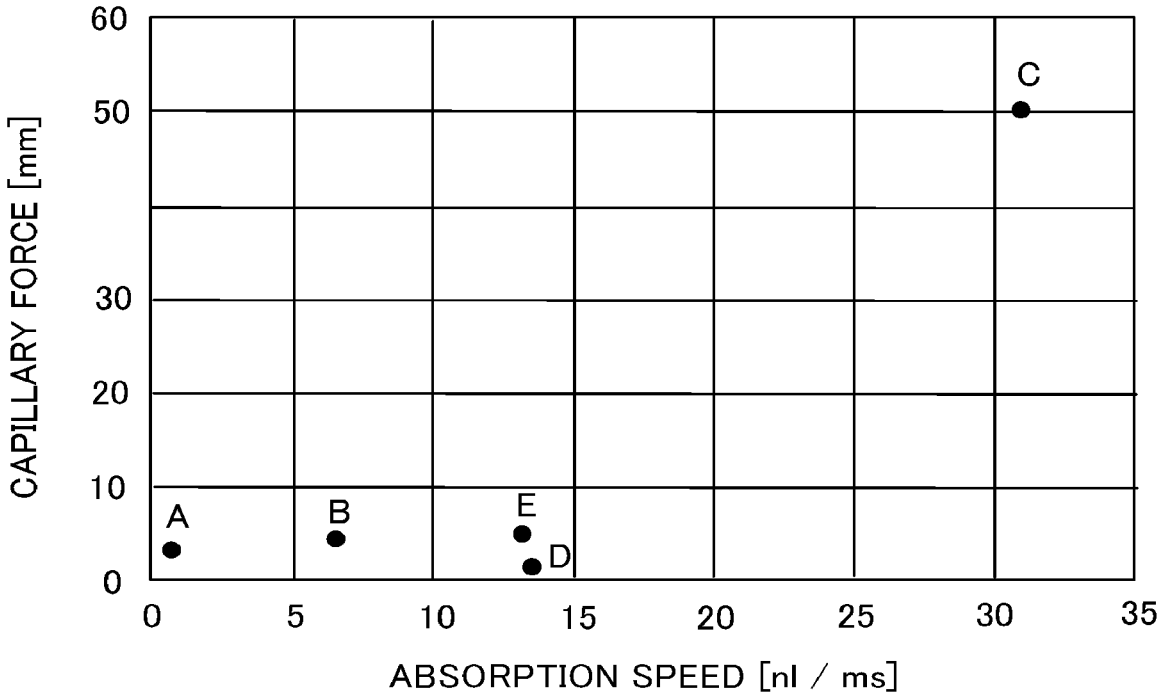
FIG. 21 is an illustration of an example of results of measurement of absorption rates and capillary forces of absorbing members A to E made of different materials.

Then, the absorption rate and the capillary force were measured for the following absorbing bodies A to E of different materials. FIG. 21 represent the results of the measurement.

A: Urethane absorbing body

B: Urethane absorbing body

C: Polyurethane absorbing body (of the product name 5000AZ-P, manufactured by Fuji Corporation)

D: Melamine absorbing body (melamine sponge; product number FU491-000X-MB, manufactured by Condor (YAMAZAKI Corporation))

E: Melamine absorbing body (Basotect (W), manufactured by Inoac Corporation)

In addition, using the above-described absorbing bodies A to E, it was confirmed whether ink deposition occurred using an ink (liquid) having a resin content of 5% by mass or more.

As a result, ink deposits occurred on the absorbing bodies A to C, and ink deposits did not occur on the absorbing bodies D and E.

As a result, it is found that the melamine absorbing body having a characteristic value with an absorption rate of more than 10 nl/ms and a capillary force of less than 10 mm causes no ink deposition even when an ink having a resin content of 5% by mass or more is used.

If the capillary force (sucking height) is large, the ink would be diffused inside the absorbing body and solidified (film-formed) inside the absorbing body. As a result, ink adhering to the surface of the absorbing body is unlikely to permeate into the absorbing body. Therefore, the capillary force (sucking height) is preferably less than 10 mm.

As described above, use of a melamine foam having a high liquid absorption rate and a small capillary force as the first absorbing member 801 allows the liquid having landed on the surface of the first absorbing member 801 to be quickly absorbed into the first absorbing member 801 and spread downward without being spread in the in-plane direction.

Such a configuration can prevent drying of ink near the surface of the first absorbing member 801 and reduce ink deposition on the surface of the first absorbing member 801 even for a liquid having a high deposition tendency and a resin content of 5% by mass or more.

Thus, the periodic replacement cycle of the first absorbing member 801 can be extended, thus reducing an increase in cost of parts for replacement and work.

Next, an ink that is a liquid having a resin content of 5% by mass or more is described.

Ink

Compositional materials of the ink (e.g., organic solvent, water, colorant, resin, and other additives) are described in detail below.

Organic Solvent

There is no specific limitation on the type of the organic solvent. For example, water-soluble organic solvents are usable. Examples thereof include, but are not limited to, polyols, ethers such as polyol alkyl ethers and polyol aryl ethers, nitrogen-containing heterocyclic compounds, amides, amines, and sulfur-containing compounds.

Specific examples of the polyols include, but are not limited to, ethylene glycol, diethylene glycol, 1,2-propanediol, 1,3-propanediol, 1,2-butanediol, 1,3-butanediol, 1,4-butanediol, 2,3-butanediol, 3-methyl-1,3-butanediol, triethylene glycol, polyethylene glycol, polypropylene glycol, 1,2-pentanediol, 1,3-pentanediol, 1,4-pentanediol 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol Examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Examples of polyol aryl ethers include, but are not limited to, ethylene glycol monophenyl ether and ethylene glycol monobenzyl ether.

Examples of nitrogen-containing heterocyclic compounds include, but are not limited to, 2-pyrrolidone, N-methyl-2-pyrrolidone, N-hydroxyethyl-2-pyrrolidone, 1,3-dimethyl-2-imidazolidinone, ε-caprolactam, and mbutyrolactone Examples of the amides include, but are not limited to, formamide, N-methylformamide, N,N-dimethylformamide, 3-methoxy-N,N-dimethylpropionamide, and 3-butoxy-N,N-dimethylpropionamide.

Examples of amines include, but are not limited to, monoethanolamine, diethanolamine, and triethylamine.

Examples of sulfur-containing compounds include, but are not limited to, dimethyl sulfoxide, sulfolane, and thiodiethanol.

Examples of other organic solvents include, but are not limited to, propylene carbonate and ethylene carbonate. In particular, organic solvents having a boiling point of 250° C. or less are preferable since such organic solvents can function as a wetting agent while providing good drying property.

As the organic solvent, a polyol compound having 8 or more carbon atoms and a glycol ether compound are also preferably used. Specific examples of the polyol compounds having 8 or more carbon atoms include, but are not limited to, 2-ethyl-1,3-hexanediol and 2,2,4-trimethyl-1,3-pentanediol.

Specific examples of the glycol ether compounds include, but are not limited to, polyol alkyl ethers such as ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether; and polyol aryl ethers such as ethylene glycol monophenyl ether and ethylene glycol monobenzyl ether.

The polyol compounds having 8 or more carbon atoms and the glycol ether compounds are capable of improving paper-permeability of the ink, which is advantageous when paper is used as a recording medium.

The proportion of the organic solvent in the ink is not particularly limited and can be suitably selected to suit to a particular application, but is preferably from 10% to 60% by mass, more preferably from 20% to 60% by mass, for drying property and discharge reliability of the ink.

Water

The proportion of water in the ink is not particularly limited and can be appropriately selected according to the objective, but is preferably from 10% to 90% by mass, more preferably from 20% to 60% by mass, for drying property and discharge reliability of the ink.

Colorant

Examples of the colorant include, but are not limited to, pigments and dyes. Usable pigments include both inorganic pigments and organic pigments. Each of the pigments may be used alone or two or more of these may be used in combination. A mixed crystal may be used as the pigment.

Usable pigments include, but are not limited to, black pigments, yellow pigments, magenta pigments, cyan pigments, white pigments, green pigments, orange pigments, glossy color pigments (e.g., gold pigments and silver pigments), and metallic pigments. Specific examples of inorganic pigments include, but are not limited to, titanium oxide, iron oxide, calcium carbonate, barium sulfate, aluminum hydroxide, Barium Yellow, Cadmium Red, Chrome Yellow, and carbon black produced by a known method such as a contact method, a furnace method, and a thermal method.

Specific examples of organic pigments include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, quinophthalone pigments), dye chelates (e.g., basic dye chelate, acid dye chelate), nitro pigments, nitroso pigments, and aniline black. Among these pigments, those having good affinity for solvents are preferable. In addition, hollow resin particles and hollow inorganic particles can also be used.

Specific examples of pigments used for black-and-white printing include, but are not limited to: carbon blacks (i.e., C.I. Pigment Black 7) such as furnace black, lamp black, acetylene black, and channel black; metals such as copper, iron (i.e., C.I. Pigment Black 11), and titanium oxide; and organic pigments such as aniline black (i.e., C.I. Pigment Black 1). Specific examples of pigments used for color printing include, but are not limited to: C.I. Pigment Yellow 1, 3, 12, 13, 14, 17, 24, 34, 35, 37, 42 (Yellow Iron Oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51; C.I. Pigment Red 1, 2, 3, 5, 17, 22, 23, 31, 38, 48:2, 48:2 (Permanent Red 2B(Ca)), 48:3, 48:4, 49:1, 52:2, 53:1, 57:1 (Brilliant Carmine 6B), 60:1, 63:1, 63:2, 64:1, 81, 83, 88, 101 (Red Iron Oxide), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4 (Phthalocyanine Blue), 16, 17:1, 56, 60, and 63; and C.I. Pigment Green 1, 4, 7, 8, 10, 17, 18, and 36.

The dyes are not particularly limited, and acid dyes, direct dyes, reactive dyes, and basic dyes can be used. Each of these can be used alone or in combination with others. Specific examples of the dyes include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the colorant in the ink is preferably from 0.1% to 15% by mass, more preferably from 1% to 10% by mass, for improving image density, fixability, and discharge stability.

Examples of the method of dispersing the pigment in the ink include, but are not limited to, a method of introducing a hydrophilic functional group to the pigment to make the pigment self-dispersible, a method of covering the surface of the pigment with a resin to disperse the pigment; and a method of dispersing the pigment by a dispersant.

In the method of introducing a hydrophilic functional group to the pigment to make the pigment self-dispersible, for example, a functional group such as sulfone group and carboxyl group may be introduced to the pigment (e.g., carbon) to make the pigment dispersible in water.

In the method of covering the surface of the pigment with a resin, for example, the pigment may be incorporated in a microcapsule to make the pigment self-dispersible in water. This pigment may be referred to as a resin-covered pigment. In this case, not all the pigment particles included in the ink should be covered with a resin. A part of the pigment particles may not be covered with any resin or may partially be covered with a resin.

In the method of dispersing the pigment by a dispersant, low-molecular dispersants and high-molecular dispersants, represented by known surfactants, may be used.

More specifically, any of anionic surfactants, cationic surfactants, ampholytic surfactants, and nonionic surfactants may be used as the dispersant depending on the property of the pigment.

As a dispersant, RT-100 (nonionic surfactant) manufactured by Takemoto Yushi Co., Ltd. and naphthalenesulfonic acid Na formalin condensate can also be suitably used as the dispersant. Each of the above dispersants may be used alone or in combination with others.

Pigment Dispersion

The ink can be obtained by mixing a pigment with other materials such as water and an organic solvent. The ink can also be obtained by, first, preparing a pigment dispersion by mixing a pigment with water, a dispersant, etc., and thereafter mixing the pigment dispersion with other materials such as water and an organic solvent.

The pigment dispersion can be obtained by mixing water, a pigment, a pigment dispersant, and other components, if any, to disperse the pigment, and adjusting the particle diameter of the pigment. Preferably, the dispersing is performed by a disperser.

Preferably, the pigment dispersed in the pigment dispersion has a maximum frequency particle diameter in the range of from 20 to 500 nm, more preferably from 20 to 150 nm, based on the number of pigment particles, from the aspects of dispersion stability of the pigment and discharge stability and image quality (e.g., image density) of the ink. The particle diameter of the pigment can be measured with a particle size analyzer (NANOTRAC WAVE-UT151 available from MicrotracBEL Corp.).

The proportion of the pigment in the pigment dispersion is not particularly limited and can be suitably selected to suit to a particular application, but is preferably from 0.1% to 50% by mass, more preferably from 0.1% to 30% by mass, for improving discharge stability and enhancing image density.

Preferably, the pigment dispersion is subjected to filtration using a filter or a centrifugal separator to remove coarse particles, followed by degassing.

Resin

The type of the resin contained in the ink is not particularly limited and can be suitably selected to suit to a particular application. Specific examples thereof include, but are not limited to, urethane resins, polyester resins, acrylic resins, vinyl acetate resins, styrene resins, butadiene resins, styrene-butadiene resins, vinyl chloride resins, acrylic styrene resins, and acrylic silicone resins.

Resin particles made of these resins may also be used. The resin particles may be dispersed in water as a dispersion medium to prepare a resin emulsion. The ink can be obtained by mixing the resin emulsion with other materials such as a colorant and an organic solvent. The resin particles may be suitably synthesized or a commercial product. The resin particles may include one type or two or more types of resin particles.

The volume average particle diameter of the resin particles is not particularly limited and can be suitably selected to suit to a particular application, but is preferably from 10 to 1,000 nm, more preferably from 10 to 200 nm, and particularly preferably from 10 to 100 nm, for good fixability and high image hardness. The volume average particle diameter can be measured with a particle size analyzer (NANOTRAC WAVE-UT151 available from MicrotracBEL Corp.).

Preferably, the proportion of the resin in the ink is 5% by mass or more, more preferably from 5% to 20% by mass, for fixability and storage stability of the ink.

The particle diameter of solid contents in the ink is not particularly limited and can be appropriately selected according to the purpose. The number-based maximum frequency of particle diameter of solid contents in the ink is preferably in the range of from 20 to 1,000 nm, more preferably from 20 to 150 nm, for improving discharge stability and image quality (e.g., image density). The solid contents include, e.g., the resin particles and pigment particles. The particle diameter can be measured with a particle size analyzer (NANOTRAC WAVE-UT151 available from MicrotracBEL Corp.).

The particle diameter of solid contents in the ink is not particularly limited and can be appropriately selected according to the purpose. The number-based maximum frequency of particle diameter of solid contents in the ink is preferably in the range of from 20 to 1,000 nm, more preferably from 20 to 150 nm, for improving discharge stability and image quality (e.g., image density). The solid contents include, e.g., the resin particles and pigment particles. The particle diameter can be measured with a particle size analyzer (NANOTRAC WAVE-UT151 available from MicrotracBEL Corp.).

Additives

The ink may further contain a surfactant, a defoamer, a preservative, a fungicide, a corrosion inhibitor, and/or a pH adjuster.

Surfactant

Usable surfactants include silicone-based surfactants, fluorine-based surfactants, ampholytic surfactants, nonionic surfactants, and anionic surfactants. The silicone-based surfactant is not particularly limited and can be suitably selected to suit to a particular application. Preferred are silicone-based surfactants which are not decomposed even in a high pH environment.

Specific examples thereof include, but are not limited to, side-chain-modified polydimethylsiloxane, both-end-modified polydimethylsiloxane, one-end-modified polydimethylsiloxane, and side-chain-both-end-modified polydimethylsiloxane. In particular, those having a polyoxyethylene group and/or a polyoxyethylene polyoxypropylene group as the modifying group are preferable because they demonstrate good characteristics as an aqueous surfactant. Specific examples of the silicone-based surfactants further include polyether-modified silicone-based surfactants, such as a dimethyl siloxane compound having a polyalkylene oxide structure on a side chain which is bound to Si.

Specific preferred examples of the fluorine-based surfactants include, but are not limited to, perfluoroalkyl sulfonic acid compounds, perfluoroalkyl carboxylic acid compounds, perfluoroalkyl phosphate compounds, perfluoroalkyl ethylene oxide adducts, and polyoxyalkylene ether polymer compounds having a perfluoroalkyl ether group on its side chain, each of which have weak foaming property. Specific examples of the perfluoroalkyl sulfonic acid compounds include, but are not limited to, perfluoroalkyl sulfonic acid and perfluoroalkyl sulfonate. Specific examples of the perfluoroalkyl carboxylic acid compounds include, but are not limited to, perfluoroalkyl carboxylic acid and perfluoroalkyl carboxylate. Specific examples of the polyoxyalkylene ether polymer compounds having a perfluoroalkyl ether group on its side chain include, but are not limited to, a sulfate ester salt of a polyoxyalkylene ether polymer having a perfluoroalkyl ether group on its side chain, and a salt of a polyoxyalkylene ether polymer having a perfluoroalkyl ether group on its side chain. Specific examples of the counter ions for these fluorine-based surfactants include, but are not limited to, Li, Na, K, $NH_4$, $NH_3CH_2CH_2OH$, $NH_2(CH_2CH_2OH)_2$, and $NH(CH_2CH_2OH)_3$.

Specific examples of the ampholytic surfactants include, but are not limited to, laurylaminopropionate, lauryl dimethyl betaine, stearyl dimethyl betaine, and lauryl hydroxyethyl betaine.

Specific examples of the nonionic surfactants include, but are not limited to, polyoxyethylene alkyl phenyl ethers, polyoxyethylene alkyl esters, polyoxyethylene alkyl amines, polyoxyethylene alkyl amides, polyoxyethylene propylene block polymers, sorbitan fatty acid esters, polyoxyethylene sorbitan fatty acid esters, and ethylene oxide adducts of acetylene alcohol.

Specific examples of the anionic surfactants include, but are not limited to, acetate, dodecylbenzene sulfonate, and laurate of polyoxyethylene alkyl ether, and polyoxyethylene alkyl ether sulfate. Each of these can be used alone or in combination with others.

The silicone-based surfactants are not particularly limited and can be suitably selected to suit to a particular application. Specific examples thereof include, but are not limited to, side-chain-modified polydimethylsiloxane, both-end-modified polydimethylsiloxane, one-end-modified polydimethylsiloxane, and side-chain-and-both-end-modified polydimethylsiloxane. More specifically, polyether-modified silicone-based surfactants having polyoxyethylene group and/or polyoxyethylene polyoxypropylene group as the modifying groups are preferable since they exhibit good properties as an aqueous surfactant.

These surfactants are available either synthetically or commercially. Commercial products are readily available from, for example, BYK Japan KK, Shin-Etsu Chemical Co., Ltd., Dow Corning Toray Co., Ltd., Nihon Emulsion Co., Ltd., and Kyoeisha Chemical Co., Ltd.

The polyether-modified silicone-based surfactants are not particularly limited and can be suitably selected to suit to a particular application. Examples thereof include, but are not limited to, a compound represented by the following general formula (S-1) that is a dimethylpolysiloxane having a polyalkylene oxide structure on its side chain bound to Si atom.

[Chem. 1]

General formula (S-1)

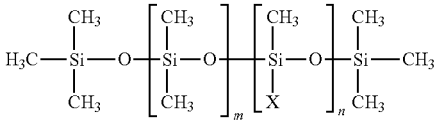

$X = -R(C_2H_4O)_a(C_3H_6O)_b R'$

In the general formula (S-1), each of m, n, a, and b independently represents an integer, R represents an alkylene group, and R' represents an alkyl group.

Specific examples of commercially-available polyether-modified silicone-based surfactants include, but are not limited to: KF-618, KF-642, and KF-643 (available from Shin-Etsu Chemical Co., Ltd.); EMALEX-SS-5602 and SS-1906EX (available from Nihon Emulsion Co., Ltd.); FZ-2105, FZ-2118, FZ-2154, FZ-2161, FZ-2162, FZ-2163, and FZ-2164 (available from Dow Corning Toray Co., Ltd); BYK-33 and BYK-387 (available from BYK Japan KK); and TSF4440, TSF4452, and TSF4453 (available from Momentive Performance Materials Inc.).

Preferably, the fluorine-based surfactant is a compound having 2 to 16 fluorine-substituted carbon atoms, more preferably a compound having 4 to 16 fluorine-substituted carbon atoms.

Specific examples of the fluorine-based surfactants include, but are not limited to, perfluoroalkyl phosphate compounds, perfluoroalkyl ethylene oxide adducts, and polyoxyalkylene ether polymer compounds having a perfluoroalkyl ether group on its side chain. Among these, polyoxyalkylene ether polymer compounds having a perfluoroalkyl ether group on its side chain are preferable since foaming property thereof is small. More specifically, compounds represented by the following general formula (F-1) or (F-2) are preferable as fluorine-based surfactants.

[Chem. 2]

$CF_3CF_2(CF_2CF_2)_m—CH_2CH_2O(CH_2CH_2O)_nH$ General formula (F-1)

In the formula (F-1), to have water-solubility, m is preferably an integer of from 0 to 10, and n is preferably an integer of from 0 to 40.

[Chem. 3]

$C_nF_{2n+1}—CH_2CH(OH)CH_2—O—(CH_2CH_2O)_a—Y$ General formula (F-2)

In the general formula (F-2), Y represents H, $C_mF_{2m+1}$ (where m represents an integer of from 1 to 6), $CH_2CH(OH)CH_2—C_mF_{2m+1}$ (where m represents an integer of from 4 to 6), or $C_pH_{2p+1}$ (where p represents an integer of from 1 to 19); n represents an integer of from 1 to 6; and a represents an integer of from 4 to 14.

The fluorine-based surfactants are available either synthetically or commercially. Specific examples of commercially-available fluorine-based surfactants include, but are not limited to: SURFLON S-111, S-112, S-113, S-121, S-131, S-132, S-141, and S-145 (available from Asahi Glass Co., Ltd.); Fluorad™ FC-93, FC-95, FC-98, FC-129, FC-135, FC-170C, FC-430, and FC-431 (available from 3M Japan Limited; MEGAFACE F-470, F-1405, and F-474 (available from DIC Corporation); Zonyl® TBS, FSP, FSA, FSN-100, FSN, FSO-100, FSO, FS-300, UR, CAPSTONE FS-30, FS-31, FS-3100, FS-34, and FS-35 (available from The Chemours Company); FT-110, FT-250, FT-251, FT-400S, FT-150, and FT-400SW (available from NEOS COMPANY LIMITED); PolyFox PF-136A, PF-156A, PF-151N, PF-154, and PF-159 (available from OMNOVA Solutions Inc.); and UNIDYNE™ DSN-403N (available from Daikin Industries, Ltd.). Among these, for improving printing quality, in particular color developing property, paper permeability, paper wettability, and uniform dying property, FS-3100, FS-34, and FS-300 (available from The Chemours Company), FT-110, FT-250, FT-251, FT-400S, FT-150, and FT-400SW (available from NEOS COMPANY LIMITED), PolyFox PF-151N (available from OMNOVA Solutions Inc.), and UNIDYNE™ DSN-403N (available from Daikin Industries, Ltd.) are particularly preferred.

The proportion of the surfactant in the ink is not particularly limited and can be suitably selected to suit to a particular application, but is preferably from 0.001% to 5% by mass, more preferably from 0.05% to 5% by mass, for improving wettability and discharge stability and enhancing image quality.

Defoamer

Specific examples of the defoamer include, but are not limited to, silicone-based defoamers, polyether-based defoamers, and fatty-acid-ester-based defoamers. Each of these can be used alone or in combination with others. Among these defoamers, silicone-based defoamers are preferable since they have excellent defoaming ability.

Preservative and Fungicide

Specific examples of the preservative and fungicide include, but are not limited to, 1,2-benzisothiazoline-3-one.

Corrosion Inhibitor

Specific examples of the corrosion inhibitor include, but are not limited to, acid sulphite and sodium thiosulfate.

pH Adjuster

The pH adjuster is not particularly limited as long as it is capable of adjusting the pH to 7 or higher. Specific examples thereof include, but are not limited to, amines such as diethanolamine and triethanolamine.

The term "liquid discharge apparatus" may be an apparatus to relatively move a head and a medium on which liquid can be adhered. However, the liquid discharge apparatus is not limited to such an apparatus. The liquid discharge apparatus may be, for example, a serial-type apparatus to move a liquid discharge head relative to a sheet material or a line-type apparatus that does not move a liquid discharge head relative to a sheet material.

The terms "image formation", "recording", "printing", "image printing", and "fabricating" are used herein as synonyms for one another.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid absorber, comprising:

an absorbing member, the absorbing member including a plurality of segments, one segment of the plurality of segments including a liquid landing surface configured to receive liquid discharged from a liquid discharge head to absorb the liquid; and a first side surface perpendicular to the liquid landing surface, the first side surface contacting a side surface of another segment of the plurality of segments, wherein the one segment of the plurality of segments includes a second side surface perpendicular to the liquid landing surface, and the second side surface contacts a side surface of still another segment of the plurality of segments, the second side surface being perpendicular to the first side surface.

2. The liquid absorber according to claim 1, wherein the plurality of segments includes three or more segments arranged so that side surfaces of adjacent two of the three or more segments contact each other.

3. The liquid absorber according to claim 2, wherein each of the plurality of segments has a same shape.

4. The liquid absorber according to claim 1 wherein the one segment of the plurality of segments has three side surfaces contacting other segments of the plurality of segments.

5. The liquid absorber according to claim 1, wherein the plurality of segments includes one or more segments on which the liquid discharged from the liquid discharge head land and one or more segments on which the liquid discharged from the liquid discharge head do not land.

6. The liquid absorber according to claim 1, further comprising another absorbing member below the absorbing member, wherein said another absorbing member is configured to absorb the liquid.

7. The liquid absorber according to claim 6, wherein an area of said another absorbing member is greater than an area of one segment of the plurality of segments of the absorbing member.

8. The liquid absorber according to claim 6, wherein the absorbing member has a higher permeability to the liquid than said another absorbing member, wherein said another absorbing member has a greater capillary force than the absorbing member.

9. The liquid absorber according to claim 4, wherein the absorbing member is a melanin foam.

10. A liquid discharge apparatus comprising:

the liquid absorber according to claim 1; and the liquid discharge head configured to discharge the liquid onto a sheet material.

11. A dummy discharge receptacle comprising a landing target member configured to receive liquid discharged from a liquid discharge head, the landing target member including a plurality of segments divided into a plurality of rows and a plurality of columns in a plane to receive the liquid discharged from the liquid discharge head.

12. The du my discharge receptacle according to claim 11, wherein the landing target member further includes a region on which the liquid discharged from the liquid discharge head does not land.

13. A liquid discharge apparatus comprising:

the dummy discharge receptacle according to claim 11; and a liquid discharge head configured to discharge the liquid onto a sheet material.

14. The liquid discharge apparatus according to claim 13, further comprising a plurality of liquid discharge heads, including the liquid discharge head, arranged in plural in both a direction of conveyance of the sheet material and a direction perpendicular to the direction of conveyance.

15. A liquid discharge apparatus, comprising:

a liquid discharge array including a plurality of liquid discharge heads arrayed in a direction perpendicular to a direction of conveyance of a sheet material;

a dummy discharge receptacle at a position opposed to the liquid discharge array; and an absorbing member accommodated in the dummy discharge receptacle, the absorbing member including a plurality of segments arranged in plural in both the direction of conveyance and perpendicular to the direction of conveyance of the sheet material, wherein the liquid discharge array is positioned to discharge liquid for dummy discharge onto the sheet material passing a sheet-material passage region and onto a segment of the plurality of segments including at least a region outside the sheet-material passing region.

16. The liquid discharge apparatus according to claim 15, wherein side surfaces of adjacent two of the plurality of segments contact each other.

17. The liquid discharge apparatus according to claim 15, wherein the plurality of segments is divided in a plane to receive the liquid discharged from the liquid discharge array.

18. The liquid discharge apparatus according to claim 15, wherein the plurality of segments has a same shape.

19. The liquid discharge apparatus according to claim 15, further comprising another absorbing member below the absorbing member, wherein said another absorbing member is configured to absorb the liquid.

20. The liquid absorber of claim 1, wherein the segments are arranged in an array having at least two rows and at least two columns.

* * * * *